United States Patent [19]

Vollers

[11] 4,307,664

[45] Dec. 29, 1981

[54] PLASTIC SHOT SHELL WAD

[75] Inventor: Gary L. Vollers, Northridge, Calif.

[73] Assignee: Merle Norman Cosmetics, Los Angeles, Calif.

[21] Appl. No.: 96,978

[22] Filed: Nov. 23, 1979

[51] Int. Cl.[3] ..... F42B 7/08

[52] U.S. Cl. ..... 102/450; 102/461; 102/532

[58] Field of Search ..... 102/42R, 42 C, 95, 448, 102/449, 450, 451, 453, 461, 532

[56] References Cited

U.S. PATENT DOCUMENTS 3,763,740 10/1973 Fletcher ..... 102/95

FOREIGN PATENT DOCUMENTS 1461675 12/1966 France ..... 102/95
1012126 3/1977 Italy ..... 102/42 C
349902 12/1960 Switzerland ..... 102/95
1291700 10/1972 United Kingdom ..... 102/95

*Primary Examiner*—Harold J. Tudor
*Attorney, Agent, or Firm*—Spensley, Horn, Jubas & Lubitz

[57] ABSTRACT

A plastic shot shell wad incorporating an improved cushioning mechanism. A cushioning effect is provided by connecting a wad with a shot cup by means of two levels of parallel walls separated by an intermediate planar member. A lower level of walls is connected to a wad portion and an upper level of walls is connected to the shot cup portion. As a charge in a shotgun shell is ignited, the lower walls will be forced through the intermediate member, which provides a resistance which has a cushioning effect. As the lower walls move forward, they will become interleaved with the upper walls. By properly locating the upper and lower walls, tilting of the wad with respect to the shot cup after firing can be minimized.

10 Claims, 4 Drawing Figures

PLASTIC SHOT SHELL WAD

BACKGROUND OF THE INVENTION

1. Field of the Invention

This invention relates to plastic wads for shotgun shells or the like.

2. Description of the Prior Art

It is known to make one piece shot holders and wads for shot shells of a flexible, deformable material such as molded plastic resin, for example polyethylene. The wad is spaced from the shot holder and connected thereto by some type of cushioning means.

The plastic shot holders protect the shot pellets from abrasion against the gun barrel, protect the pellets against deformation by being forced against the hard surface of the barrel, carry the shot pellets as a concentrated unit out of the gun barrel, and separate readily from the shot pellets soon after they leave the barrel. The wad portion is generally provided with a skirt which deforms outwardly against the gun barrel to inhibit passage of the expanding gases of the burning powder charge past the wad. The cushion between the wad and the shot holder cushions the impact of the expanding gases from the powder charge on the shot pellets to prevent the pellets from being deformed.

Various types of cushioning devices have been employed in the prior art. These devices include collapsable vertical walls located around the periphery of the wad, diagonal struts, crossed support walls, foam cushions and air chambers. Although all of these devices provide a cushion effect, they do not function with equal effectiveness. A major problem to be overcome is that the cushioning should be accomplished without tilting the wad, which might break the gas seal and cause transverse deflection of the wad and possibly the shot holder, not only within the gun barrel but also to the extent of interfering with the trajectory of the shot as it leaves the barrel.

Most wad designs also include a skirt which extends from the wad and contacts the gun barrel. The gas pressure of the powder charge will expand the skirt of the wad to form a gas seal. Generally, the skirt is tapered outwardly and rearwardly so that its own resilience and memory forces it into tight engagement with the shot shell casing wall to prevent initial leak of the expanding gases. Any gases escaping past the wad will not only lessen the muzzle velocity of the shot leaving the gun barrel, but will also pass through the shot in the holder to disturb the shot pattern.

It is a primary object of the present invention to provide a plastic shot shell wad which has an improved cushioning effect in comparison with the prior art.

SUMMARY OF THE INVENTION

The present invention comprises a plastic wad and shot holder for a shot shell which includes a new type of cushioning device. The wad is a disc shaped member having a downwardly extending skirt which serves as a gas seal. The shot holder comprises a tubular member having a planar lower end. The wad and the shot holder are connected to one another by means of a two level cushioning device. The first level of the cushioning device includes at least one vertical wall portion which extends perpendicularly downwardly from the bottom of the shot holder. The end of the wall is connected to the upper surface of a deformable planar member which is substantially parallel to the bottom of the shot holder.

The second level of the cushioning device includes at least one vertical wall extending perpendicularly downwardly from the lower surface of the planar member. The end of the wall is connected to the upper surface of the wad.

The upper walls and lower walls lie in interleaved planes which are parallel to one another. The total number of upper and lower walls must be at least three. When the shell is fired, the wad and lower walls will move forward and deform the planar member. The deformation of the planar member provides a cushioning effect between the wad and the shot holder. The movement of the lower walls causes them to become interleaved with the upper walls. In order to prevent tilting of the wad as it moves, the cushioning device may be designed so that as the lower walls move forward and interleave with the upper walls, they are adjacent to the upper walls and therefore constrained against anything other than forward movement.

DESCRIPTION OF THE PREFERRED EMBODIMENT

Figure 1:
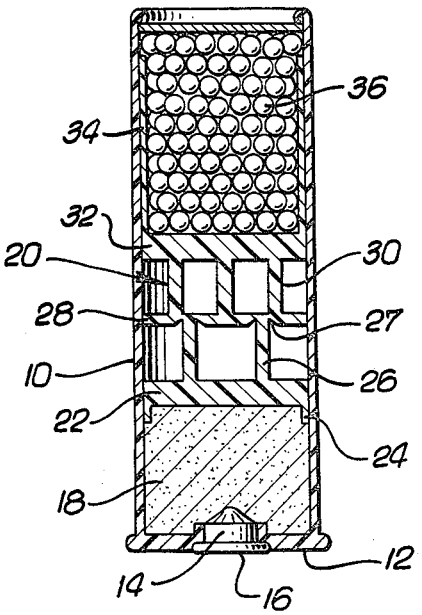
FIG. 1 is a sectional view of a shotgun shell including the wad of the present invention.
Figure 2:
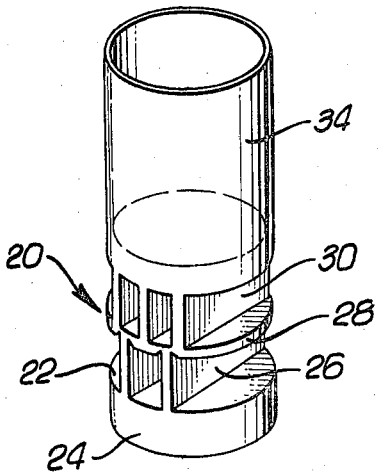
FIG. 2 is a perspective view of the wad.

Referring to FIGS. 1 and 2, a shotgun shell includes a tubular body portion 10 having a relatively thick end portion 12 which includes an opening 14. The shell is preferably made of a high strength plastic material such as high density polyethylene or polycarbonate material. A primer 16 is positioned on a shoulder within the opening 14. Located within the end of the housing 10 adjacent the end portion 12 is a charge 18. The charge 18 is secured within the shell by means of a wad structure 20. The structure 20 includes a lower support disc or wad 22 which has a skirt 24 extending downwardly from its lower edge. The skirt 24 is preferably tapered outwardly somewhat so that it provides a gas seal against the inside wall of the housing 10. When the charge 18 is ignited, the skirt 24 will be forced outwardly against the wall of the housing 10 in order to improve the gas seal.

Extending upwardly from the top of the wad 22 are a pair of parallel walls 26 which extend across the surface of the wad 22. The tops of the walls 26 are attached to two grooved portions 27 of a circular planar member 28 which has a diameter generally equal to that of the wad 22. The walls 26 are substantially perpendicular to the planar member 28, and the planar member 28 is therefore parallel to the wad 22. Extending vertically from the top surface of the planar member 28 are three parallel walls 30. The walls 30 are positioned so that they lie in planes which are interleaved with the planes of the walls 26. Preferably, the planes of the walls 26 are adjacent to the planes of the outer two walls 30. The plane of the inner wall 30 is located between and spaced from the planes of the walls 26.

The tops of the walls 30 are connected to a circular base section 32 of a tubular shot cup 34. The base 32 is substantially parallel to the planar member 28 and wad 22, and the wall of the shot cup 34 is adjacent to the inside wall of the housing 10. Located within the shot cup 34 are a plurality of shot pellets 36. The wad assembly 20 thus includes three major portions: a wad portion which includes the wad 22 and the skirt 24, a cushion portion which includes the walls 26 and 30 and the planar member 28, and a shot cup portion which includes the base 32 and shot cup 34. The entire structure 20 is a one piece injection molded product.

Figure 3A:
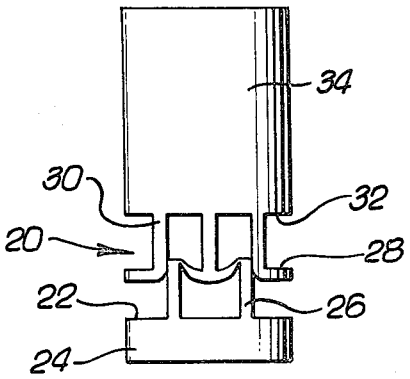
FIGS. 3*a* and 3*b* are side views showing the deformation of the cushioning portion of the wad upon firing of the shell.
Figure 3B:
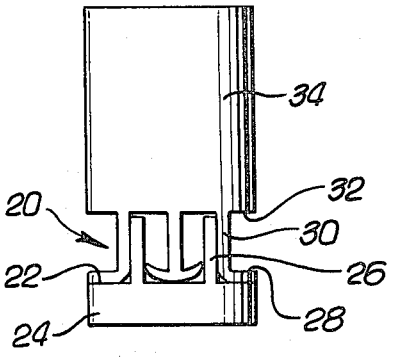

Referring now to FIGS. 3*a* and 3*b*, the deformation and cushioning action of the wad structure 20 will be described. When the charge 18 is ignited, the wad 22 will be forced in the direction of the shot cup 34 as shown in FIG. 3*a*. *This causes the walls 26 to push against the grooves 27 of the planar member 28. As the force generated by the charge 18 pushes the walls 26 against the grooves 27, the planar member 28 will be deformed, thus providing a cushioning effect between the wad 22 and the shot cup 34. As the force of the charge 18 increases, the walls 26 will move upwardly, eventually breaking through the planar member 28, and become interleaved with the walls 30. The length of the walls 26 and 30 are substantially equal and the tops of the walls 26 will eventually come into or close to contact with the bottom of the base 32, as shown in FIG. 3b.* At this point, the resiliency of the polyethylene material used to make the wad structure 20 will still provide a cushioning effect between the wad 22 and the shot holder 34.

From the above description, it is apparent that by providing two sets of vertical walls between which is connected a resilient planar member, a cushioning effect will be provided as the lower walls are forced against the planar member. The planar member will initially flex to provide a cushioning effect. The planar member may be designed so that the lower walls will either flex the planar member 28 or break completely through it. Either way, the resiliency of the material provides a cushioning effect. If the planar member is designed to simply flex, the planes of the lower walls 26 would be spaced from the planes of the upper walls 30. However, it is preferable that the lower walls 26 break through the planar member 28 and become interleaved with the upper walls 30. For this reason, the planes of the lower walls 26 should be adjacent to the planes of the outer two upper walls 30. With this configuration, when the lower walls 26 break through the planar member 28, they will slide against the upper walls 30. The walls 26 and 30 are relatively stiff along their length, and their meshing will prevent any tilting of either the wad 22 or the shot cup 34. This tilting will be prevented because the meshed arrangement effectively locks the lower walls 26 between the two outer walls 30 to prevent any pivoting between the walls 26 and 30.

Although the invention is shown as having three upper walls and two lower walls, the number of walls utilized is not critical. For example, a wad structure having two upper walls and one lower wall which would slide between the two upper walls could also be used, although the tilting prevention would not be as effective. In addition, a shot cup need not be included in the present invention. In such a case, the cushioning device would basically include three planar members interconneting two levels of parallel walls.

Although the invention has been described in terms of a single embodiment, it is recognized that modifications and variations may readily occur to those skilled in the art and consequently it is intended that the claims be interpreted to cover such modifications and equivalents.

I claim:

1. A unitary molded plastic wad for a shot shell comprising:

a planar member having an upper and lower surface;

at least one upper support wall extending substantially perpendicularly upwardly from said upper surface;

a circular member having a generally planar end, wherein said end is connected to the top of said at least one upper support wall and is parallel to said planar member;

at least one lower support wall extending substantially perpendicularly downwardly from said lower surface, wherein said upper and lower support walls lie in interleaved substantially parallel planes, wherein the total number of said upper and lower support walls is at least three and wherein the lower support wall lies in a plane adjacent to the plane of the upper support wall;

a lower support disc which is parallel to the planar member and connected to the bottom of said at least one lower support wall, whereby when an upward force is applied to the lower support disc the planar member will deform and the upper and lower support walls will be forced into an interleaved arrangement, said lower support walls sliding into contact with said upper support walls, said interleaved arrangement thereby preventing pivoting between said upper and lower support walls.

2. The shot shell wad of claim 1 wherein there are three of said upper support walls and two of said lower support walls.

3. The shot shell wad of claim 2 wherein the planes of said lower support walls are adjacent to the planes of the outer two of said three upper support walls and spaced from the plane of the middle one of said three upper support walls.

4. The shell wad of claim 2 wherein the lower surface of said planar member includes a pair of grooves, wherein one of said lower support walls is connected to the planar member along one of the grooves and the other of said lower support walls is connected to the planar member along the other of the grooves, whereby the depth of said grooves controls the rate of deformation of the planar member.

5. The shell wad of claim 1 wherein the planar member is circular and the diameter of the circular member, planar member and support disc are substantially equal.

6. The shell wad of claim 5 wherein said support walls extend to the edges of said tubular member, planar member and support disc.

7. The shell wad of claim 6 wherein said support disc includes a downwardly extending peripheral lip.

8. The shell of claim 1 wherein said circular member has a tubular shot cup extending upwardly from its periphery.

9. The shell wad of claim 8 in combination with a molded plastic tubular shell having a closed end, a powder charge located in the closed end of the shell and covered by the support disc of the wad, and a supply of shot located within the shot cup.

10. The shell wad of claim 1 wherein said lower support walls break through said planar member and slide against said upper support walls when said upward force is applied to said lower support disc.

* * * * *